US007854218B2

(12) United States Patent
Kapus et al.

(10) Patent No.: US 7,854,218 B2
(45) Date of Patent: Dec. 21, 2010

(54) METHOD TO RECOGNIZE AND AVOID PREMATURE COMBUSTION EVENTS

(75) Inventors: Paul Kapus, Judendorf (AT); Mario Ninaus, Seiersberg (AT)

(73) Assignee: AVL List GmbH, Graz (AT)

( * ) Notice: Subject to any disclaimer, the term of this patent is extended or adjusted under 35 U.S.C. 154(b) by 605 days.

(21) Appl. No.: 11/892,416

(22) Filed: Aug. 22, 2007

(65) Prior Publication Data

US 2008/0183367 A1 Jul. 31, 2008

(30) Foreign Application Priority Data

Aug. 24, 2006 (AT) ..... A 1413/2006

(51) Int. Cl.
*F02D 41/00* (2006.01)

(52) U.S. Cl. ..... 123/435

(58) Field of Classification Search ..... 123/435, 123/406.12, 406.38, 406.41, 406.18; 701/103, 701/111

See application file for complete search history.

(56) References Cited

U.S. PATENT DOCUMENTS

| | | | | |
|---|---|---|---|---|
| 4,492,203 | A * | 1/1985 | Yutaka | 123/478 |
| 4,617,895 | A * | 10/1986 | Sakakibara et al. | 123/406.38 |
| 4,759,319 | A * | 7/1988 | Merritt | 123/51 AA |
| 5,101,790 | A * | 4/1992 | Takasu et al. | 123/406.38 |
| 5,424,647 | A * | 6/1995 | Ohsawa et al. | 324/378 |
| 5,743,227 | A * | 4/1998 | Jacquet et al. | 123/179.3 |
| 6,427,662 | B2 | 8/2002 | Tanaya et al. | |
| 6,742,500 | B2 | 6/2004 | Sauler et al. | |
| 7,121,250 | B2 * | 10/2006 | Yokoyama | 123/196 R |

FOREIGN PATENT DOCUMENTS

| | | |
|---|---|---|
| DE | 4034523 | 5/1991 |
| DE | 19755256 | 6/1999 |
| DE | 19908729 | 9/2000 |
| DE | 10064088 | 1/2002 |
| DE | 10041777 | 3/2002 |
| DE | 10043700 | 3/2002 |
| JP | 58025559 | 2/1983 |
| JP | 62251450 | 11/1987 |

OTHER PUBLICATIONS

English Abstract of DE 10041777, (Mar. 2002).
English Abstract of DE 19755256, (Jun. 1999).
English Abstract of JP 58025559, (Feb. 1983).
English Abstract of JP 62251450, (Nov. 1987).

* cited by examiner

*Primary Examiner*—Hieu T Vo
(74) *Attorney, Agent, or Firm*—Dykema Gossett PLLC

(57) ABSTRACT

A method for recognizing and avoiding premature combustion events includes the steps of:

providing at least one sensor and/or an electronic evaluation circuit for recognizing premature combustion;

directly recognizing premature combustion; and performing at least one measure for avoiding premature combustion when premature combustion is recognized.

16 Claims, 2 Drawing Sheets

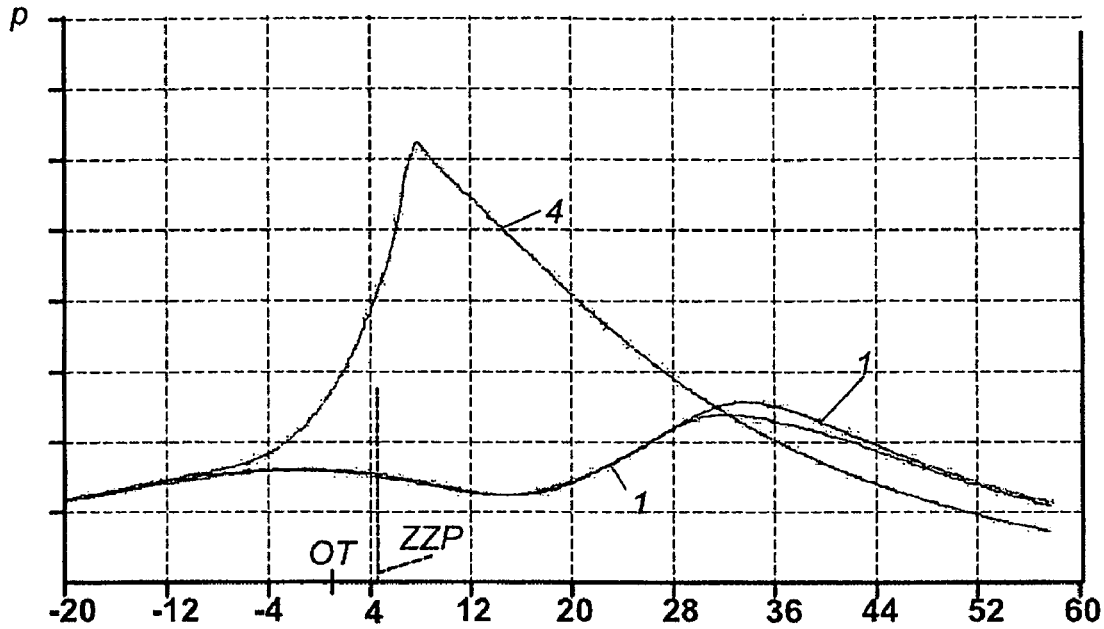
Fig.3
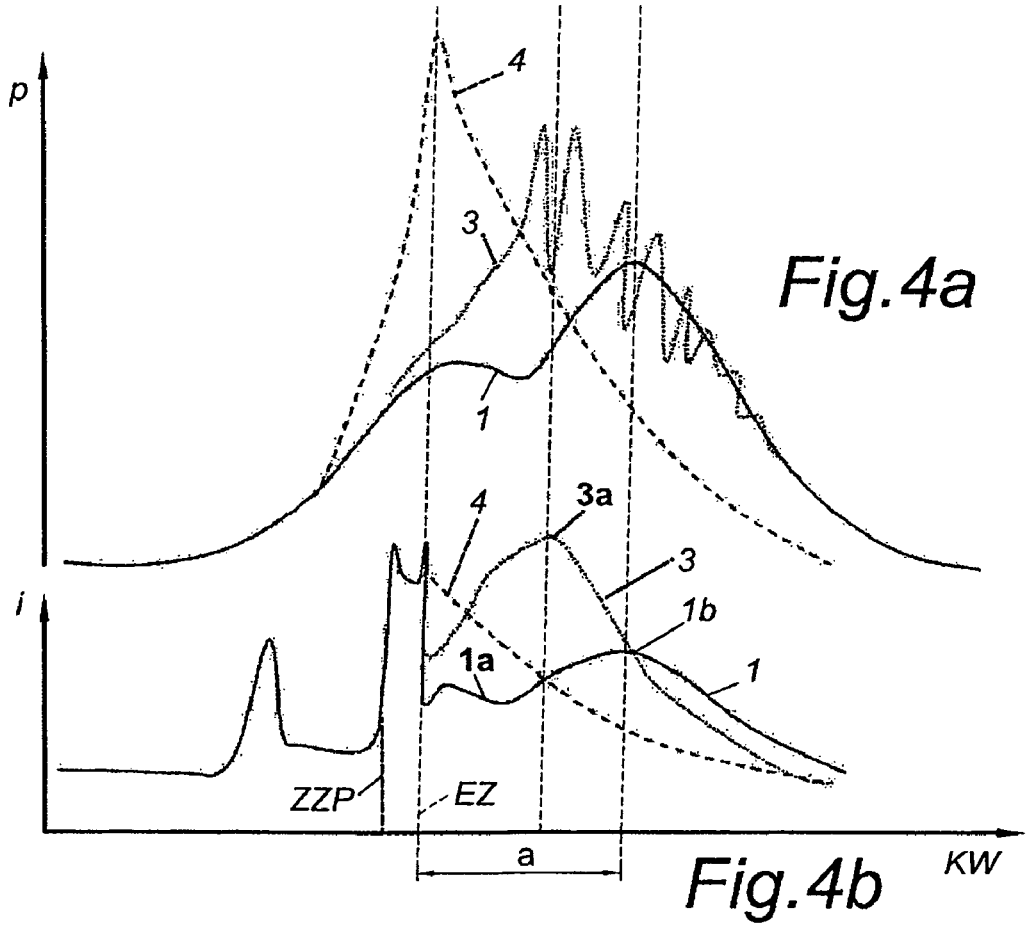
Fig.4a
Fig.4b

METHOD TO RECOGNIZE AND AVOID PREMATURE COMBUSTION EVENTS

BACKGROUND OF THE INVENTION

The invention relates to a method for recognizing and avoiding premature combustion events.

DESCRIPTION OF THE PRIOR ART

In known applications of knocking control systems, internal combustion engines are operated permanently with variable ignition angles that are individual to the cylinder, with the ignition angle being adjusted in the direction of "early" from knock-free operation until knocking is recognized. Then there is a reversal of the ignition point in the direction of "late", leading to the avoidance of knocking as a result of the thus ensuring temperature reduction in the combustion chamber. After the adjustment to late of the ignition to secure knock-free operation, the same is adjusted again in the direction to "early" according to an up-regulation strategy, i.e. in the direction of the increased tendency towards knocking.

By using a knocking sensor for recognizing knocking and the associated optimized feedback control strategy, the internal combustion engine is operated as close as possible to the knocking threshold. As a result of a too quick adjustment to early of the ignition angle to the knocking threshold after a knocking event for example, there may be an increase in the thermal load in the combustion chamber as a result of the reduced cooling period. This feedback control strategy which is designed to minimize efficiency losses can initiate a premature combustion after a certain period of time. Premature combustions also additionally occur especially in charged high-performance spark-ignition engines through deposits for example or by unburned fuel or oil in the combustion chamber.

These premature combustions do not cause typical knocking features and are therefore not detected by currently used knocking sensors and their signal processing systems. Since a premature combustion entails a strong pressure increase in the compression phase and strongly increased combustion temperatures, such abnormal combustion processes lead to engine damage within a short period of time.

It is known from DE 100 43 700 A1 and DE 199 08 729 A1 to reduce knocking, i.e. abnormal combustion processes, by knock-reducing measures such as shifting the ignition point to late or by performing multiple injections. These measures influence only abnormal combustion processes which are initiated by the ignition spark, but not the premature combustions which are more hazardous to the internal combustion engine and which are not initiated by the ignition spark. Premature combustions cannot be influenced by shifting the ignition to late.

It is further known to reduce knocking by increased exhaust gas recirculation, see JP 58-025559 A.

JP 62-251450 A describes a device for reducing knocking, with different knock-prevention measures being taken in the high-load range and under acceleration in the part-load range. The quantity of the air intake is reduced in the full-load range and in the part-load range there is a shift of the ignition point to late.

SUMMARY OF THE INVENTION

It is the object of the invention to perform a secure and simple recognition of premature combustion for an internal combustion engine and to subsequently avoid premature combustion.

This is achieved in accordance with the invention by the following steps:

- Providing at least one sensor and/or an electronic evaluation circuit for the immediate and direct recognition of premature combustion;
- direct recognition of premature combustion;
- performing at least one measure for avoiding premature combustion when premature combustion is recognized.

It may be provided that the recognition of premature combustion occurs by permanent monitoring of the sensor signal within a defined measuring window and by evaluation of the sensor signal, preferably by means of an integral process and/or maximum evaluation process. In a simple embodiment of the invention it can be provided that a cylinder pressure sensor signal, an acceleration sensor signal and/or a knock sensor signal is used as a sensor signal, with a premature combustion preferably being detected when cylinder pressure detected prior to the ignition point and/or the rise of the cylinder pressure before the ignition point exceeds a defined threshold value.

Preferably, the immediate and direct recognition occurs by monitoring at least one engine parameter influenced directly by the premature combustion, preferably the pressure curve in the cylinder. The invention makes use of the fact that a premature combustion is linked to a strong rise in pressure in the compression phase. It is possible to draw clear conclusions to premature combustion through the occurrence of this characteristic strong rise in pressure in the compression phase. It is irrelevant for the recognition of the premature combustion whether the premature combustion occurs with or without knocking.

The permanent monitoring can also occur by means of an electronic evaluation circuit by evaluating the ionic current at the spark plug. A cylinder pressure sensor is not mandatory here. It is possible to draw conclusions for premature combustion based on the progress of the ionic current signal after the end of the ignition spark. In the case of normal combustion there is a certain known distance between the end of the ignition spark and the time of maximum peak pressure (ionic current signal). The ionic current signal has a characteristic curve, with the ionic current dropping suddenly after the end of the ignition spark and with the drop being followed by a first maximum value that can be associated to chemical ionization and, at a distance from the spark end, a higher second maximum value that can be associated with thermal ionization. In the case of irregular combustion, this distance is considerably reduced or even smaller than or equal to zero. It is possible to deduce irregular combustion from this signal too. An additional possibility is offered by the amplitude of the ionic current signal. The higher the signal, the higher the thermal load. In the case of progressing (continued) irregular combustion, the ionic current signal would rise strongly. Measures can also be derived from this effect.

If very early combustion occurs (start of combustion very clearly before the ignition point or early in the compression phase), these two maximum values are not very distinctive. In the case of very early combustion, which typically occurs without any knocking because at the time of exceeding the knocking threshold the entire fuel has been combusted or the flame has reached the combustion chamber wall, the ionic current signal curve has a substantially continually dropping progress after the spark end by the falling thermal signal, without extreme values. If premature combustion occurs in combination with knocking (knocking as a consequence of premature combustion, but still with unburned mixture in the combustion chamber after exceeding the knocking threshold), then a maximum value in the ionic current signal can be determined as a consequence of thermal ionization which occurs much earlier than in the case of normal combustion and whose amplitude is substantially higher than in the case of regular combustion.

Premature combustion without knocking events can thus be determined in such a way that the ionic current signal after the spark end drops continually within the measuring window, without maximum values occurring.

A premature combustion with knocking events can be recognized when a maximum value of the ionic current signal which can be allocated to the combustion peak pressure lies above a defined threshold value and/or occurs within a defined period after the end of the spark.

It is further possible that an acceleration sensor signal is used as a sensor signal, with the evaluation of the sensor signal preferably occurring by a maximum evaluation process.

A fourth embodiment of the invention provides that a knock sensor is used as a sensor signal, with the evaluation of the sensor signal preferably occurring by a maximum evaluation process.

It can further be provided that a speed signal is used as a sensor signal, with the recognition of premature combustion occurring as a result of angular acceleration values derived from the speed sensor signal. Premature combustion leads to a rise in the cylinder pressure clearly before top dead center. As a result of this clearly too early rise in the cylinder pressure, the force acting via the connecting rod on the crankshaft changes. The torque generated by this one cylinder decreases or rises depending on the starting position of the combustion relative to the optimum. The rotational non-uniformity of the crankshaft changes, which means that the angular acceleration of the crankshaft decreases or increases as a reaction to the premature combustion in a cylinder. It is possible to define a bandwidth of permissible rotational non-uniformity, outside of which irregular combustion can be diagnosed. The detection of irregular combustion via rotational non-uniformity can be used together with other measures of detection of irregular combustion or later combustion (recognition of misfires).

An effective measure for preventing premature combustion consists of reducing the engine load of at least the pertinent cylinder. It can preferably be provided that the reduction of the engine load is performed at least partly by leaning out or enriching the respective cylinder.

As an alternative to this or in addition it can be provided that the reduction of the engine load occurs at least partly by reducing the intake manifold pressure.

If the premature combustions exceed a certain frequency, there must be reduction in the engine load in order to avoid endangering the internal combustion engine.

In an older patent application of the applicant it was proposed to perform at least one examination step for distinguishing between a spark-induced normal knocking event and a premature combustion only in the case of the occurrence of a knocking event.

It was checked whether the amplitude of the knocking event lies above a first knocking threshold for normal knocking. It was further checked whether the amplitude of the knocking event lies above a defined second knocking threshold for premature combustion. The knocking event was only identified as premature combustion on exceeding the second knocking threshold. By providing a knocking sensor and through the joint use of the evaluation circuit and amplifying steps there are certain limitations in the recognition of premature combustion, which in the worst case leads to the failure to recognize premature combustion.

The performance of such examination steps is not necessary in the present method because the recognition of premature termination occurs directly through the pressure increase during the compression phase and by the ionic current progress after the end of the spark, and not by comparing the amplitudes with defined knocking thresholds. This allows recognizing premature combustion relatively quickly and implementing respective countermeasures immediately. Damage as a consequence of premature combustion can thus be prevented especially effectively.

Furthermore, as a result of this method of immediate recognition of premature combustion, the likelihood of false recognitions decreases (initiation of measures without occurrence of premature combustion).

The recognition of premature combustion occurs preferably completely independently of the recognition of a knocking combustion. That is why premature combustion can occur only when no knocking event occurs.

BRIEF DESCRIPTION OF THE DRAWINGS

The invention is now explained in closer detail by reference to the drawings, wherein:

FIG. 3 shows the pressure curve during a premature combustion without knocking;

FIG. 4*a* shows the cylinder pressure signals for regular and irregular combustions, and FIG. 4*b* shows ionic current signals for regular and irregular combustion processes.

DESCRIPTION OF THE PREFERRED EMBODIMENT

FIGS. 1 to 4*a* show the cylinder pressure p entered over the crank angle KW.

Figure 1:
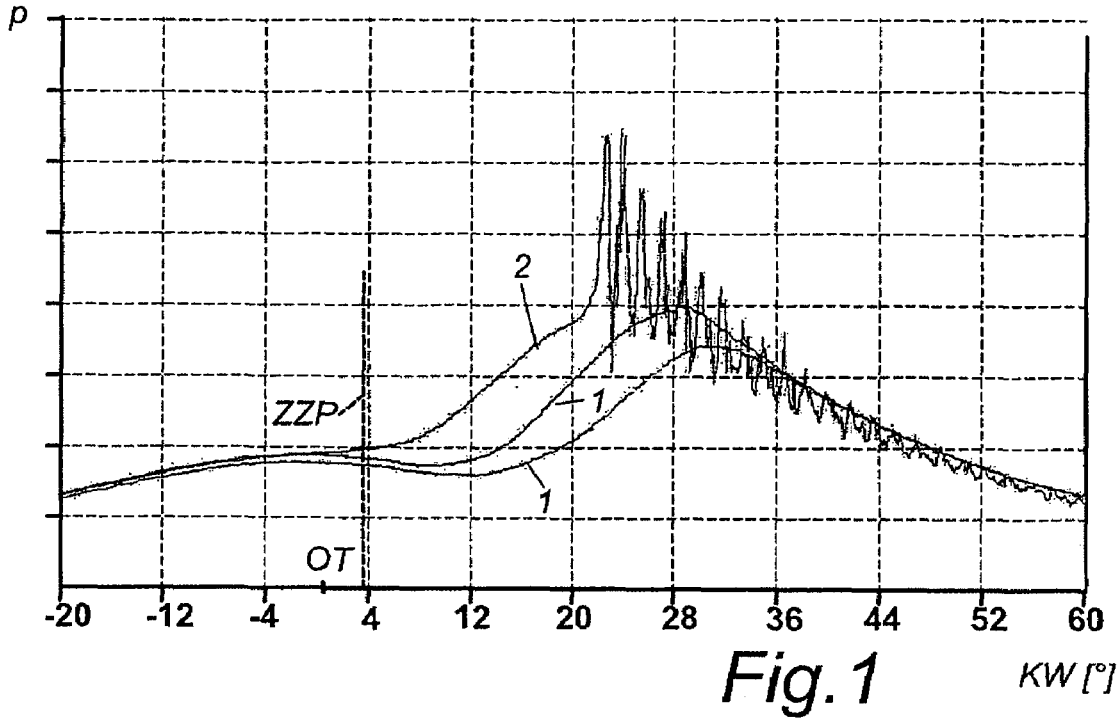
FIG. 1 shows the pressure curve in a spark-induced combustion with knocking.

As is clearly shown in FIG. 1, a pressure increase occurs only after the ignition point ZZP in the case of knocking combustion 2. This increase in pressure after the ignition point ZZP is thus a characteristic feature of knocking combustion.

The reference pressure curves with regular combustion are designated with reference numeral 1.

Figure 2:
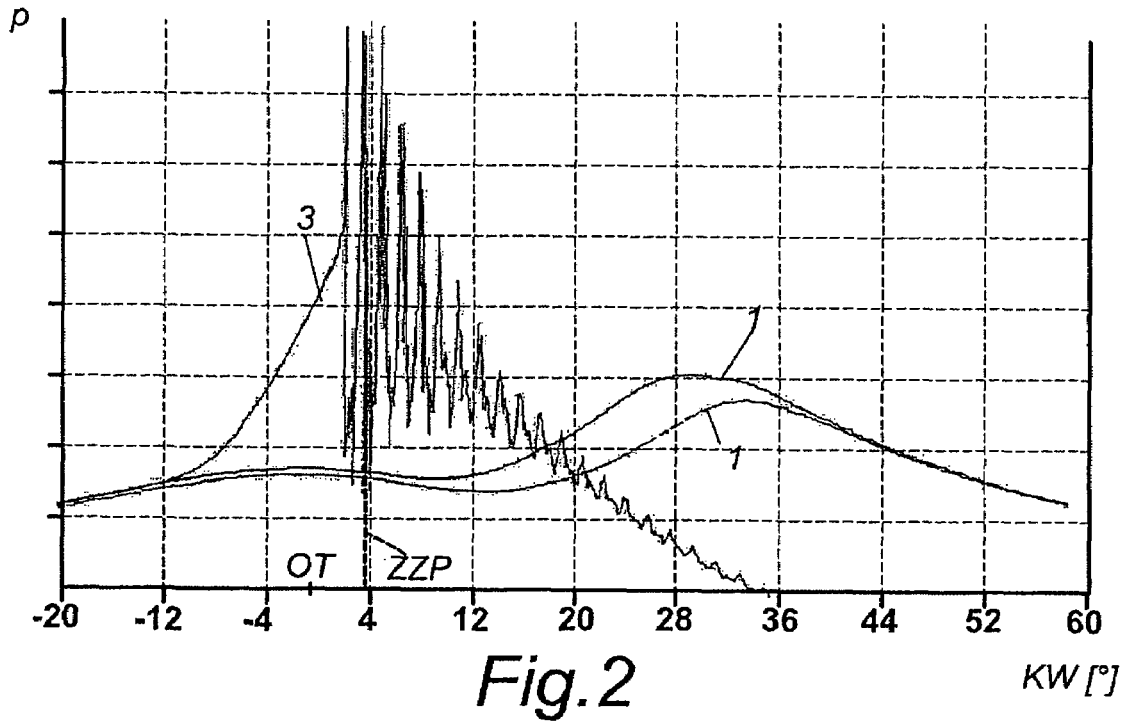
FIG. 2 shows the pressure curve in a premature combustion with knocking.

The pressure curve in the case of premature combustion 3, 4 differs substantially from the same, as is shown in FIGS. 2 and 3.

FIG. 2 shows a premature combustion 3 with knocking. The feature of this premature combustion is that the pressure increase occurs before the ignition point ZZP. A too strong pressure increase before the ignition point ZZP leads to the consequence that a strongly superimposed knocking is initiated when at the time of the exceeding of the knocking threshold there is still unburned mixture in the combustion chamber.

FIG. 3 shows a premature combustion 4 without knocking. In this case too, the pressure increase occurs clearly before the ignition point ZZP. Since in this first phase of the combustion the ignitable mixture has been combusted entirely, there is no superimposed knocking.

Since a premature combustion, with or without knocking, is linked to a strong pressure increase in the compression phase, a distinct recognition of premature combustion with or without knocking can occur at a very early stage, namely in real time, by monitoring the pressure curve in the compression phase.

As an alternative or in addition to the evaluation of the cylinder pressure, the recognition of the premature combustion can also be made on the basis of an ionic current signal i at the spark plug, as is shown in FIGS. 4*a* and 4*b*. The cylinder pressure signals p and the ionic current signals i are shown over the crank angle KW for regular combustion 1 and premature combustion 3, 4.

It is possible to conclude premature combustion from the curve of the ionic current signal i after the end EZ of the spark. In the case of a normal combustion 1, the ionic current signal i has a characteristic curve, with the ionic current signal i dropping suddenly after the end EZ of the spark. The drop of the ionic current signal i is followed by a first maximum value 1*a* which can be allocated to chemical ionization. A higher second maximum value 1*b* which can be allocated to thermal ionization follows at a distance a to the spark end EZ, the occurrence of which coincides with the combustion peak pressure. When a premature combustion 3, 4 occurs, these two maximum values 1*a*, 1*b* are not distinct.

When premature combustion 3 occurs in combination with knocking, a maximum value 3*a* can be noticed in the ionic current signal i as a result of thermal ionization, which occurs however earlier than in the case of normal combustion 1. The amount of maximum value 3*a* is substantially larger than the maximum values 1*a* and 1*b* during normal combustion. A premature combustion 3 with knocking events can be recognized when a maximum value 3*a* of the ionic current signal i which can be allocated to thermal ionization lies over a defined threshold value and/or occurs within a defined period a after the spark end EZ. The threshold value can be formed for example by the highest maximum value 1*b* of the ionic current signal occurring under regular combustion after the spark end EZ.

When extremely premature combustion 4 occurs without knocking, the ionic current signal curve i has a substantially continually dropping progress (without extreme values) after the spark end EZ. A premature combustion without knocking events can thus be recognized in such a way that the ionic current signal i after the spark end EZ decreases continually at least within the chosen measuring window a, without maximum values occurring.

By recognizing the position of the combustion with ionic current measurement or by recognizing the time difference between the ignition spark and the peak pressure position it is possible to reliably distinguish between normal combustion 1 and premature combustion 3, 4.

The invention claimed is:

1. A method for recognizing and avoiding premature combustion events in an internal combustion engine, comprising the following steps:

providing at least one sensor and/or an electronic evaluation circuit for the direct recognition of premature combustion;

direct recognition of premature combustion;

performing at least one measure for avoiding premature combustion when premature combustion is recognized, and wherein the recognition of premature combustion occurs by permanent monitoring of a sensor signal within a defined measuring window and by evaluation of the sensor signal.

2. The method according to claim 1, wherein the evaluation of the sensor signal happens by means of an integral process.

3. The method according to claim 1, wherein the evaluation of the sensor signal happens by means of a maximum evaluation process.

4. The method according to claim 1, wherein at least one sensor signal selected from the group cylinder pressure sensor signal, acceleration sensor signal or knock sensor signal is used.

5. The method according to claim 4, wherein a premature combustion is detected when the sensor signal detected prior to the ignition point exceeds a defined threshold value.

6. The method according to claim 4, wherein a premature combustion is detected when the rise of the sensor signal before the ignition point exceeds a defined threshold value.

7. The method according to claim 1, wherein an ionic current sensor signal is used as a sensor signal.

8. The method according to claim 7, wherein a premature combustion is recognized when the ionic current signal continually drops within the measuring window after an end of a spark.

9. The method according to claim 7, wherein a premature combustion is recognized when a maximum value of the ionic current signal which can be allocated to the combustion peak pressure lies above a defined threshold value.

10. The method according to claim 7, wherein a premature combustion is recognized when a maximum value of the ionic current signal which can be allocated to the combustion peak pressure occurs within a defined period after the end of the spark.

11. The method according to claim 1, wherein a speed signal is used as a sensor signal, with the recognition of premature combustion occurring as a result of angular acceleration values derived from a speed sensor signal.

12. The method according to claim 1, wherein a measure for preventing premature combustion consists of a reduction of an engine load of at least a pertinent cylinder.

13. The method according to claim 1, wherein the measure for preventing premature combustion consists of a reduction of an engine air-fuel mixture strength of the pertinent cylinder.

14. The method according to claim 1, wherein the measure for preventing premature combustion consists of an increase in the engine air-fuel mixture strength of the pertinent cylinder.

15. The method according to claim 1, wherein the measure for preventing premature combustion consists of a cut-off of a fuel supply at least of the pertinent cylinder.

16. A method for recognizing and avoiding premature combustion events in an internal combustion engine, comprising the following steps:

providing at least one sensor and/or an electronic evaluation circuit for the direct recognition of premature combustion;

direct recognition of premature combustion;

performing at least one measure for avoiding premature combustion when premature combustion is recognized, and wherein a recognition of premature combustion occurs completely independent of a recognition of a knocking combustion.

* * * * *